US005944226A

United States Patent [19]

Schiltz et al.

[11] Patent Number: 5,944,226

[45] Date of Patent: Aug. 31, 1999

[54] ADD-ON VALVE ASSEMBLY FOR DUAL-COMPONENT CARTRIDGE

[75] Inventors: William C. Schiltz, Canton; Frederick D. Wasmire, Alliance, both of Ohio

[73] Assignee: Liquid Control Corporation, North Canton, Ohio

[21] Appl. No.: 08/873,144

[22] Filed: Jun. 9, 1997

[51] Int. Cl.[6] ..... B67D 5/52

[52] U.S. Cl. ..... 222/137; 222/145.6; 222/145.7; 222/326; 222/459

[58] Field of Search ..... 222/137, 145.5, 222/145.6, 145.7, 326, 327, 459, 554, 555

[56] References Cited

U.S. PATENT DOCUMENTS

| | | | |
|---|---|---|---|
| 4,366,919 | 1/1983 | Anderson | 222/137 |
| 4,846,373 | 7/1989 | Penn et al. | 222/137 |
| 5,027,981 | 7/1991 | Magister | 222/137 |
| 5,370,271 | 12/1994 | Segatz | 222/326 |
| 5,462,204 | 10/1995 | Finn | 222/137 |
| 5,529,245 | 6/1996 | Brown | 222/145.7 |

FOREIGN PATENT DOCUMENTS

| | | | |
|---|---|---|---|
| 3518780 | 11/1986 | Germany | 222/145.7 |

*Primary Examiner*—Joseph A. Kaufman

*Attorney, Agent, or Firm*—Sand & Sebolt

[57] ABSTRACT

An add-on valve assembly for dual-component cartridge has a valve member and a retainer nut which secures the valve member to a dual-component material cartridge. The valve member includes a body having a forwardly extending threaded nozzle and rearwardly extending top and bottom tubes. First and second passageways are formed in the top and bottom tubes, respectively, and extend through the body and nozzle. A valve stem extends generally vertically within the body and is rotatably mounted therein. The valve stem is formed with top and bottom holes which align with the first and second passageways, respectively, when the add-on valve assembly is rotated to an open position and which extend perpendicular to the first and second passageways, respectively, when the add-on valve assembly is rotated to a closed position. The tubes are adapted to extend within respective passageways of the material cartridge and communicate with a pair of chambers formed within the material cartridge. A handle is used to rotate the valve stem between the open position which allows the materials contained within the material cartridge to flow through the first and second passageways and a closed position which prevents the material from flowing through the first and second passageways. A motionless mixing tube may threadably engage the nozzle of the valve member to mix the materials before the materials are dispensed from the material cartridge.

13 Claims, 4 Drawing Sheets

ADD-ON VALVE ASSEMBLY FOR DUAL-COMPONENT CARTRIDGE

BACKGROUND OF THE INVENTION

1. Technical Field

The invention relates to valves. Particularly, the invention relates to a valve assembly for a dual-component cartridge containing two materials which are to be mixed together and dispensed. More particularly, the invention relates to an add-on valve assembly which removably mounts to a nozzle of the cartridge for controlling the flow of the materials from the cartridge and which is removed from the nozzle after use for cleaning and disposing of any material remaining in the valve assembly after the materials have been emptied from the cartridge.

2. Background Information

Various types of material cartridges have been developed which store two separate materials, such as chemically reactive resins or resins and a hardener, which materials must be maintained out of contact with each other within the cartridge. These cartridges are typically formed with two separate chambers, each chamber storing one of the reactive materials. These chambers are formed in the cartridge in various configurations. For example, the chambers may be formed in a side-by-side relationship within the cartridge whereby the materials are positioned adjacent one another and separated by a thin wall formed integrally with the cartridge housing. The materials flow through respective passageways formed in a valve member and nozzle of the cartridge and are mixed by a motionless mixing tube upon exiting the nozzle.

In another example of a dual-component cartridge, the chambers are formed coaxially within the cartridge. One of the materials is stored within a cylindrical inner chamber and the other material is stored within an annular outer chamber. The material passageway of the inner chamber is off-center allowing the passageways to be formed adjacent one another within a single nozzle.

In a further example of a dual-component material cartridge, the chambers may be formed either side by side or coaxially. One of the materials is stored within one of the chambers while the other material is stored within a sausage or chubb which is inserted within the empty chamber of the side-by-side cartridge or within the inner chamber of the coaxial cartridge. When pressure is applied to the chubb, the thin flexible film which encloses the material ruptures allowing the materials to be dispensed from the cartridge.

As previously mentioned, these dual-component material cartridges have a nozzle and valve member formed integrally with the outer housing of the cartridge. The nozzle and valve member are formed with a pair of passageways through which the separate materials flow when being dispensed. When the materials are dispensed they flow through the separate passageways into some type of mixing tube where they are thoroughly mixed before being applied to an application surface.

One type of valve member which can be formed on the material cartridge is shown in U.S. Pat. No. 4,846,373 which discloses an apparatus for proportioning or for proportioning and mixing plural different fluid compositions. A neck is formed integrally with and extends forwardly from the cartridge housing and is formed with a pair of passageways each of which communicates with one of the material chambers of the housing. An opening is formed between a threaded nozzle of the cartridge and the neck for receiving a valve stem. The valve stem is formed with two holes which rotate to communicate with the passageways of the neck and nozzle when the valve stem is in the open position, and which rotate perpendicular to the passageways of the neck and nozzle when the valve stem is in the closed position. A motionless mixing tube may threadably engage the nozzle to mix and dispense the materials.

Although this valve member is adequate for the purpose for which it is intended, forming the valve integrally with the cartridge causes disposal problems when the cartridge is emptied and is to be discarded by the user. The pressure mechanism which forces the materials from the cartridge extends only up to a front wall of the cartridge and thus does not completely evacuate the passageways of the neck, valve member and nozzle of the cartridge leaving a residual amount of material therein. Occasionally, these material cartridges contain environmentally hazardous materials, the disposal of which is strictly regulated by various governmental agencies, such as the Environmental Protection Agency. These hazardous materials must be placed in special containers before being properly disposed of by a government-approved waste disposal company.

The cost of disposing of these hazardous material containers is relatively expensive and thus it is undesirable to place an entire material cartridge in the containers if the chambers of the containers do not contain any of the hazardous material. It would be advantageous to simply remove the nozzle and valve which contain the hazardous material and which would occupy a lot less space in the disposal container thus reducing the amount of wasted space in the hazardous material container previously occupied by the empty material cartridges.

Further, by forming the valve integrally with the material cartridge, the packaging and shipping size of the material cartridge is increased substantially. The length of the shipping container must be extended beyond the length of the valve member and nozzle, thus increasing both the packaging and shipping costs. The add-on valve assembly of the present invention would reduce the length of the shipping container requiring the container to have a length only slightly longer than the cylindrical body of the material cartridge. The valve assembly could be sold as a separate unit. Depending on the type of materials being dispensed by the material cartridge, the valve assembly could be cleaned and re-used on new material cartridges.

Therefore, the need exists for an improved add-on valve assembly for dual-component cartridges which is removably secured to a nozzle of the cartridge, which can be removed from the cartridge allowing the valve assembly and the materials which remain in the valve assembly to be cleaned therefrom or properly discarded and which reduces the size of the packaging and shipping container of the material cartridge.

SUMMARY OF THE INVENTION

Objectives of the invention include providing an improved add-on valve assembly for dual-component cartridges which may be threadably secured to a nozzle of the cartridge to dispense two materials contained within separate chambers of the cartridge.

Another objective is to provide a valve assembly which is readily attachable at one end to the nozzle of the cartridge and which readily receives a mixing tube at the other end for mixing the two material components as they are dispensed from the cartridge.

A further objective is to provide a valve assembly which may be easily removed from the cartridge after the materials have been dispensed from the cartridge.

Another objective is to provide a valve assembly in which any residual material remaining in the cartridge after the materials have been dispensed therefrom will be contained within the passageways of the valve assembly.

A still further objective is to provide a valve assembly which allows the empty material cartridge to be discarded after use and which allows any hazardous material remaining in the valve assembly to be properly disposed of in a hazardous material container.

A further objective is to provide a valve assembly which reduces the amount of wasted space in a hazardous waste container occupied by the empty material cartridge.

Another objective is to provide a valve assembly which allows only those parts containing a hazardous material to be discarded in the hazardous waste container.

A still further objective is to provide a valve assembly which is of simple construction, which achieves the stated objectives in a simple, effective and inexpensive manner, and which solves problems and satisfies needs existing in the art.

These objectives and advantages are obtained by the improved addon valve assembly for dual-component cartridges, the general nature of which may be stated as including a valve member adapted to be attached to the nozzle of the material cartridge, said valve member having at least two tubes, each tube communicating with a respective chamber of the material cartridge, a dispensing nozzle, and valve means positioned between the tube and the dispensing nozzle and movable between open and closed positions for controlling the flow of the materials out of the material cartridge; and retention means for removably securing the valve member to the material cartridge.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
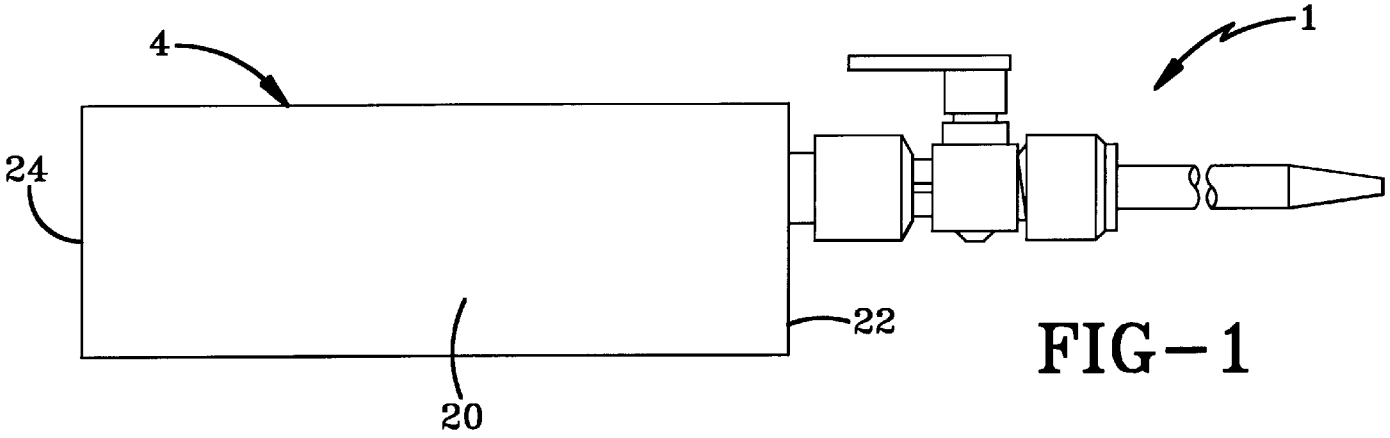
FIG. 1 is a side elevational view of a coaxial type of two-component dispensing cartridge having the improved add-on valve assembly mounted thereon, with a helical mixer mounted on the discharge end thereof.
Figure 2:
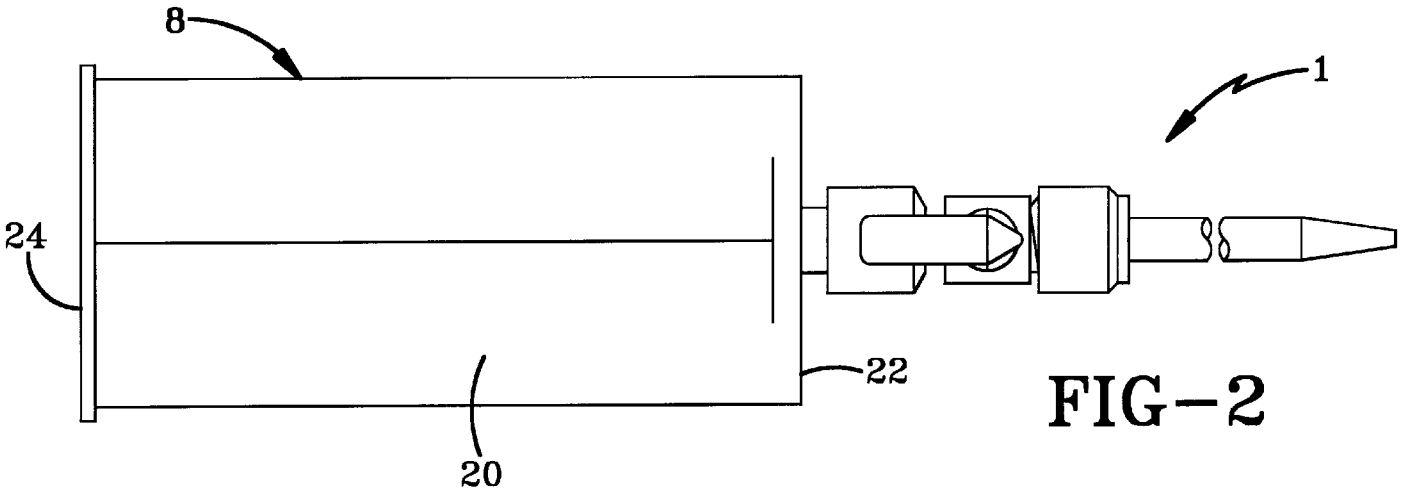
FIG. 2 is a top plan view of a side-by-side type of two-component dispensing cartridge with the add-on valve assembly and helical mixer mounted thereon.
Figure 3:
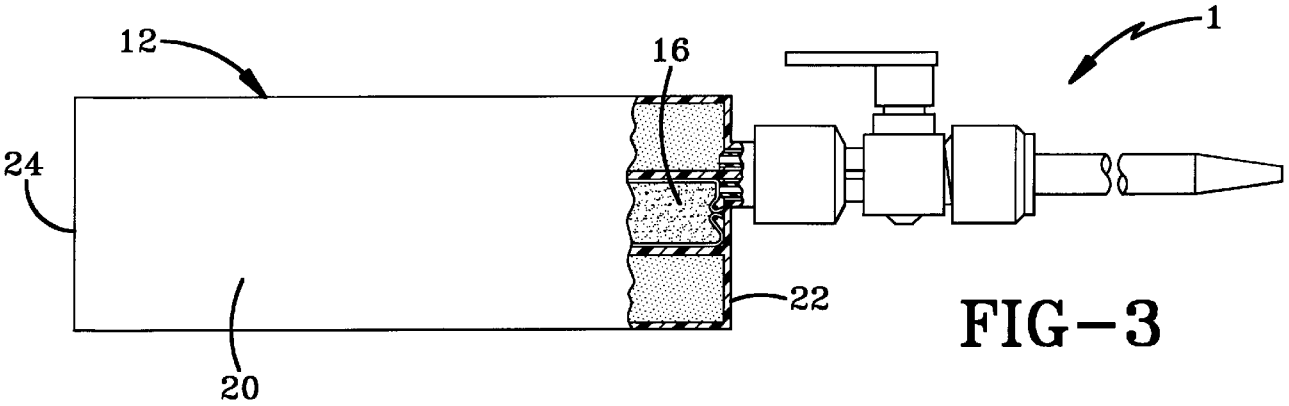
FIG. 3 is a side elevational view of the coaxial type of two-component dispensing cartridge with a portion shown in section to show a material chubb stored within the inner chamber, and having the add-on valve assembly and helical mixer mounted thereon.

The add-on valve assembly for dual-component cartridges of the present invention is shown in FIGS. 1–3 and is indicated generally at 1. Valve assembly 1 may be removably added on to a coaxial material cartridge 4 (FIG. 1), a side-by-side material cartridge 8 (FIG. 2) or a coaxial material cartridge 12 (FIG. 3) which contains a material chubb 16 in a middle cylindrical chamber thereof. Cartridges 4, 8 and 12 all include a tubular cylindrical body 20 formed with a front closure wall 22 and an open rear end 24. A nozzle 26 (FIG. 4) is formed integrally with front wall 22 and extends forwardly therefrom. Nozzle 26 includes a neck portion 28 having external threads 30. A pair of passageways 32 and 34 (FIG. 6) are formed in nozzle 26 for dispensing the materials contained within housing 20.

Figure 6:
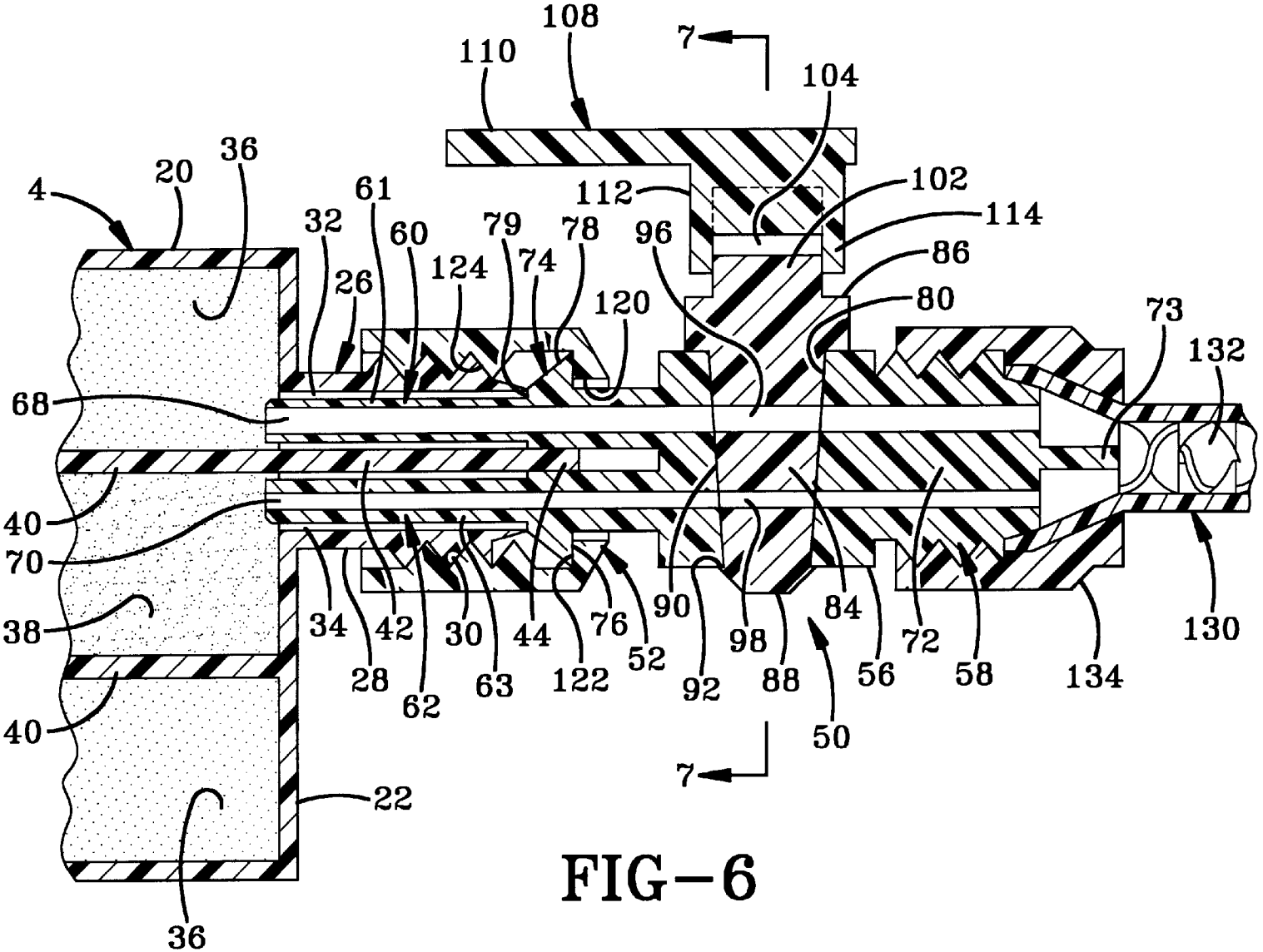
FIG. 6 is an enlarged fragmentary sectional view of the add-on valve assembly mounted on the discharge end of the coaxial two-component cartridge, as shown in FIG. 1, with the helical mixer being mounted on the outlet end thereof.

Housing 20 is formed with a pair of chambers 36 and 38 separated from one another by an inner wall 40. Although coaxial material cartridge 4 is the only material cartridge shown in detail (FIG. 6), each of material cartridges 4, 8 and 12 is formed with a pair of chambers similar to chambers 36 and 38 and separated by an inner wall 40. As shown in FIG. 6, material cartridge 4 is formed with cylindrical inner chamber 38 and annular outer chamber 36 which extends around inner chamber 38. Wall 40 of material cartridge 4 is cylindrical and separates inner chamber 38 from outer annular chamber 36. Inner wall 40 is formed integrally within body 20 and includes a small extension 42 which extends within nozzle 26 to separate passageways 32 and 34. Extension 42 includes a front end 44 which extends beyond the end of nozzle 26 to prevent the materials from commingling as the materials travel through passageways 32 and 34 and out nozzle 26. The materials stored in the cartridges may be a liquid, paste, resin, slurry or any type of material which is movable and flowable under pressure and will be hereinafter referred to as a liquid material.

Figure 4:
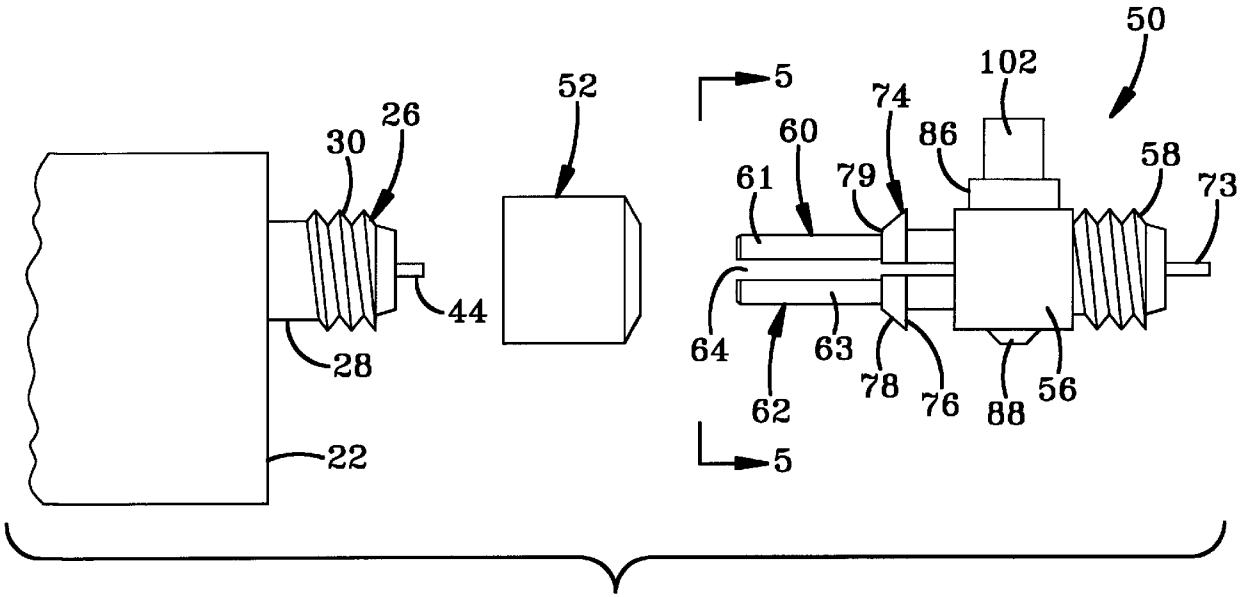
FIG. 4 is an enlarged exploded elevational view of the add-on valve assembly of the present invention.
Figure 7:
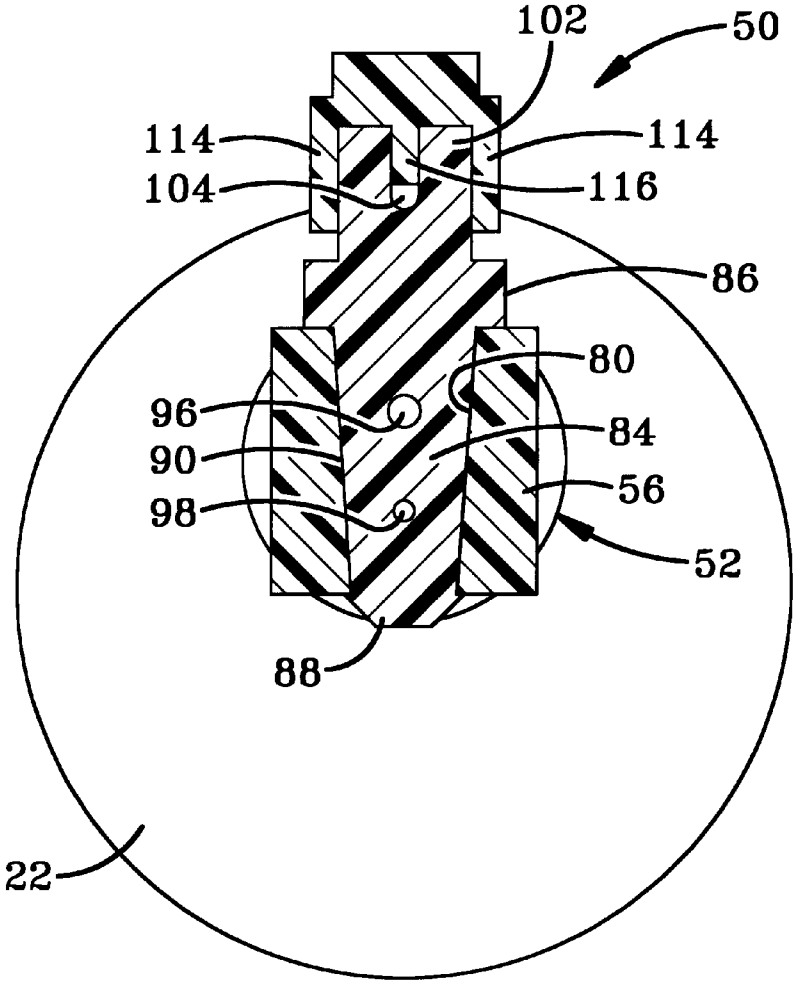
FIG. 7 is a sectional view taken along line 7—7, FIG. 6.
Figure 5:
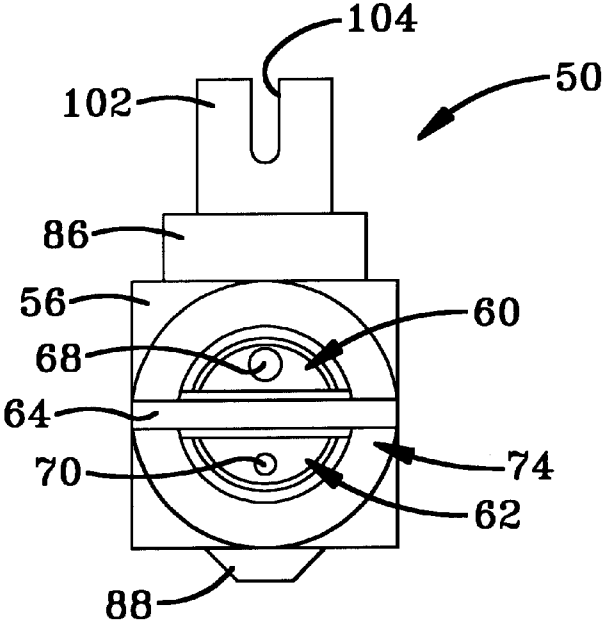
FIG. 5 is an enlarged end elevational view of the valve assembly looking in the direction of arrows 5—5, FIG. 4.

In accordance with one of the features of the invention, add-on valve assembly 1 includes a valve member 50 and a retainer nut 52 (FIG. 4). Valve member 50 includes a main body 56 having a forwardly extending threaded nozzle 58 and a pair of rearwardly extending top and bottom tubes 60 and 62, respectively. Tubes 60 and 62 are formed by a pair of generally semicircular-shaped walls 61 and 63, respectively, (FIG. 5) which are spaced from one another by a gap 64. A first cylindrical-shaped passageway 68 (FIG. 6) is formed in top tube 60 and extends through main body 56 and nozzle 58. A second passageway 70 is formed in bottom tube 62 parallel to first passageway 68 and extends through main body 56 and nozzle 58 parallel to first passageway 68.

A wall 72 extends within nozzle 58 between passageways 68 and 70 to separate the passageways from one another. Wall 72 has a forwardly extending extension 73 similar to extension 42 of nozzle 26 which extends beyond the end of nozzle 58 to prevent the liquid materials from commingling as the materials travel through passageways 68 and 70 and out nozzle 58 as described below. Each tube 60 and 62 is formed with a barbed outer collar 74 which has a front locking shoulder 76 and an angled rear surface 78 which truncates to form a flat edge 79.

Passageways 68 and 70 of tubes 60 and 62, respectively, may be formed with various diameters to control the flow rate and mixture ratio of the liquid materials stored in chambers 36 and 38, respectively. Passageway 68 of tube 60 is shown in FIG. 6 having a larger diameter than passageway 70 of tube 62 allowing a greater amount of material to flow through passageway 68. The smaller passageway of tube 60 is formed by a thicker wall 61. Walls 61 and 63 must have an outer size which corresponds generally to the size of passageways 32 and 34, respectively, with the thickness of the tube walls controlling the size of passageways 68 and 70 to limit the amount of liquid material flowing therebetween.

Main body 56 is formed with a vertically extending opening 80 which is tapered slightly from top to bottom and which is formed generally perpendicular to passageways 68 and 70. Opening 80 receives a valve stem 84 which has an upper enlarged head portion 86 and a lower tail portion 88. Valve stem 84 is generally cylindrical and has a tapered outer surface 90 complimentary in shape to opening 80. Tail portion 88 is barbed to form a shoulder 92 which cooperates with enlarged head portion 86 to rotatably secure stem 84 within opening 80. Enlarged head 86 abuts the top of main body 56 and shoulder 92 abuts the bottom of main body 56 allowing stem 84 to vertically rotate within main body 56 as described below.

Stem 84 is formed with top and bottom holes 96 and 98, respectively, which extend transversely through stem 84 and which axially align with passageways 68 and 70, respectively, when valve assembly 1 is in the open position. Stem 84 has a rectangular-shaped top end 102 formed with a generally U-shaped groove 104. An L-shaped handle 108 has a horizontal first section 110 and a vertical second section 112. Vertical section 112 includes a pair of side walls 114 and a center wall 116. Vertical section 112 of handle member 108 engages top end 102 of stem 84 with center wall 116 extending within groove 104 and side walls 114 extending adjacent each side of upper end 102 of stem 84.

In accordance with another of the features of the invention, retainer nut 52 is formed with a circular opening 120 which receives tubes 60 and 62 of valve member 50. A flat annular locking shoulder 122 is formed around the inner surface of retainer nut 52 adjacent the front end thereof. A plurality of threads 124 are formed around the inner surface of retainer nut 52 adjacent the rear end thereof.

A motionless mixing tube 130 removably attaches to nozzle 58 of valve member 50. Motionless mixing tube 130 is of the type shown in U.S. Pat. No. 4,014,463 and includes a stationary helical mixing element 132. A coupling 134 threadably engages nozzle 58 to retain motionless mixing tube 132 to add-on valve assembly 1. The liquid materials stored in material cartridge 4 may be a chemically reactive resin or a resin and a hardener. Motionless mixing tube 130 thoroughly mixes the two liquids as they are dispensed to create a resin or other liquid compound.

When valve assembly 1 is in the assembled position, tubes 60 and 62 are inserted through opening 120 at the front of retainer nut 52. The edge of opening 120 will cam against angled rear surfaces 78 of barbed collars 74. In the preferred embodiment add-one valve assembly 1 is formed from a somewhat resilient plastic material. The resiliency of the plastic and gap 64 allow tubes 60 and 62 to flex toward one another providing clearance for barbed collars 74 to cam along the front edge of opening 120 as tubes 60 and 62 extend within retainer nut 52. When locking shoulder 76 of barbed collar 74 clears locking shoulder 122 of retainer nut 52, the resiliency of tubes 60 and 62 allows the tubes to snap back to their original position locking retainer nut 52 to valve member 50.

Tubes 60 and 62 are inserted within passageways 32 and 34, respectively, until the front edge of nozzle 26 abuts flat edges 79 of barbed collars 74. Extension 42 which separates passageways 32 and 34 extends within gap 64 between tubes 60 and 62. The rear ends of tubes 60 and 62 extend slightly into chamber 36 and 38, respectively, and retainer nut 52 is screwed on to nozzle 26 with locking shoulders 76 and 122 engaging one another to retain add-on valve assembly 1 on material cartridge 4. Motionless mixing tube 130 easily attaches to nozzle 58 to receive and mix the materials as the materials are dispensed from the cartridge. Extension 73 extends slightly into mixing tube 130 adjacent stationary mixing element 132 to keep the materials separated until the materials contact mixing element 132.

Handle member 108 is used to rotate stem 84 between an open position in which holes 96 and 98 align with passageways 68 and 70, respectively, and a closed position in which holes 96 and 98 extend perpendicular to passageways 68 and 70, respectively. Enlarged head portion 86 and handle 108 may have a position indicator such as a pair of arrows which align when stem 84 is rotated to the open or closed position.

In use, handle member 108 is rotated to the open position aligning holes 96 and 98 with passageways 68 and 70, respectively. A pressure is applied to rear end 24 of the material cartridge forcing the materials from chambers 36 and 38 through passageways 68 and 70, respectively, of tubes 60 and 62, respectively. The materials will flow through holes 96 and 98 and into motionless mixing tube 130 where they are thoroughly mixed by helical mixing element 132. To stop the flow of material from chambers 36 and 38 handle member 108 is pivoted 90° rotating stem 84 and positioning holes 96 and 98 perpendicular to passageways 68 and 70 thus restricting the flow of material through add-on valve assembly 1.

When chamber 36 and 38 have been emptied, retainer nut 52 is unscrewed from nozzle 26 allowing add-on valve assembly 1 to be removed from the material cartridge. The pistons used to force the material from chambers 36 and 38 will have been forced forwardly until they abut front wall 22 of the material cartridge, thus emptying chambers 36 and 38 of the material contents therein. When the pistons have been pushed to abut front wall 22, no additional pressure can be applied to the material thus leaving a small amount of residual material in nozzle 26 and valve assembly 1. This residual material which was not forced from the material cartridge remains in passageways 68 and 70 of tubes 60 and 62, respectively, and is removed from nozzle 26 when valve assembly 1 is removed from its engagement with the material cartridge.

In the event the material cartridge contains a hazardous material, any residual hazardous residual material will be contained within valve assembly 1 and motionless mixing tube 130, and will be removed from the material cartridge when valve assembly 1 is removed from nozzle 26 thus eliminating the need to place the large bulky empty material cartridge in a hazardous waste container.

Accordingly, add-on valve assembly 1 attaches to various types of material cartridges and may be removed therefrom after use. Tubes 60 and 62 extend within passageways 32 and 34, respectively, and communicate with chambers 36 and 38, respectively, to allow the material contained within cartridges 36 and 38 to flow through add-on valve assembly 1. Stem 84 rotates between an open position whereby holes 96 and 98 communicate with passageways 68 and 70, respectively, and a closed position whereby holes 96 and 98 extend perpendicular to passageways 68 and 70. Retainer nut 52 engages barbed collar 74 to hold valve member 50 in engagement with nozzle 26 of the material cartridge. Threaded nozzle 58 of valve member 50 allows motionless mixing tube 130 to be attached thereto to thoroughly mix the two materials prior to the materials being dispensed. Upon completion of dispensing the materials contained within the material cartridge, add-on valve assembly 1 contains any residual material which was not dispensed and the add-on valve assembly may be removed from the material cartridge and discarded in a waste container or cleaned for subsequent re-use.

Accordingly, the improved add-on valve assembly for dual-component cartridge is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved add-on valve for dual-component cartridge is constructed and used, the characteristics of the construction, and the advantageous, new and useful results obtained; the new and useful structures, devices, elements, arrangements, parts and combinations, are set forth in the appended claims.

We claim:

1. A combination compressing a cartridge for containing two liquid materials and an add-on valve assembly controlling the flow of the liquid materials from the cartridge;

said cartridge including a housing formed with two chambers, each chamber adapted to contain one of the liquid materials;

a cartridge nozzle connected to and extending outwardly from an end wall of the housing;

a pair of cartridge passageways formed within the cartridge nozzle, each of said passageways communicating with a respective one of the chambers;

said add-on valve assembly including a valve body formed with a pair of passageways, a valve stem mounted in said body and movable between open and closed positions for controlling the flow of the materials from the cartridge and a dispensing nozzle; and retention means for removably securing valve assembly to an outer end of the cartridge nozzle whereby each of the valve body passageways aligns with a respective one of the nozzle passageways.

2. The combination defined in claim 1 further including a motionless mixing tube connected to the dispensing nozzle of the valve member, said motionless mixing tube having a stationary mixing element for mixing the two liquid materials.

3. The combination defined in claim 2 further including the pair of spaced valve passageways formed in the valve member, each of said passageways extending through one of the respective tubes, and through the valve means and the dispensing nozzle.

4. The combination defined in claim 3 further including a body portion extending between the tubes and the dispensing nozzle.

5. The combination defined in claim 4 in which the body portion is formed with an opening which communicates with the passageways of said valve member.

6. The combination defined in claim 5 in which the valve means further includes the rotatable valve stem positioned within the opening of the body portion, said valve stem being formed with at least two holes which align with a respective valve passageway of the valve member when the valve means is in the open position.

7. The combination defined in claim 6 in which the retention means includes a nut which engages the valve member to threadably secure the valve member to the cartridge nozzle.

8. The combination defined in claim 1 in which the valve assembly includes a pair of tubes extending outwardly from the valve body and aligning with a respective one of the passageways of said valve body; and in which said tubes project into the respective passageways of the cartridge nozzle.

9. The combination defined in claim 1 in which the cartridge nozzle includes external threads and in which the retention means includes a nut provided with internal threads which engage the external threads of the cartridge nozzle to threadably secure the valve body to the cartridge nozzle.

10. The combination defined in claim 9 in which the nut is formed with an opening surrounded by the internal threads and in which each of the tubes is formed with a barbed outer collar which engages the nut adjacent said opening for securing said nut to the valve body.

11. The combination defined in claim 1 in which the valve body is formed with an opening which communicates with the passageways; and in which the valve stem is positioned within the opening of said body and is rotatable along a rotational axis.

12. The combination defined in claim 11 in which at least two holes are formed in the valve stem transverse to the rotational axis of the stem, each of said holes aligning with a respective passageway of the valve body when the valve stem is in the open position.

13. The combination defined in claim 12 in which the valve stem further includes an enlarged head which abuts a top surface of the body and a barbed tail which abuts a bottom surface of the body to rotatably secure the valve stem within said opening.

* * * * *